US009612068B2

(12) United States Patent
Burden

(10) Patent No.: US 9,612,068 B2
(45) Date of Patent: Apr. 4, 2017

(54) AMMUNITION STATUS REPORTING SYSTEM

(71) Applicant: Grypshon Industries LLC, Toledo, OH (US)

(72) Inventor: Tom Joseph Burden, Toledo, OH (US)

( * ) Notice: Subject to any disclaimer, the term of this patent is extended or adjusted under 35 U.S.C. 154(b) by 0 days.

(21) Appl. No.: 14/985,471

(22) Filed: Dec. 31, 2015

(65) Prior Publication Data

US 2016/0195351 A1 Jul. 7, 2016

Related U.S. Application Data

(60) Provisional application No. 62/100,145, filed on Jan. 6, 2015.

(51) Int. Cl.

| | |
|---|---|
| ***F41A 9/62*** | (2006.01) |
| ***F41G 1/34*** | (2006.01) |
| *F41G 1/02* | (2006.01) |
| *F41G 1/30* | (2006.01) |
| *F41G 1/38* | (2006.01) |

(52) U.S. Cl.
CPC ..... *F41A 9/62* (2013.01); *F41G 1/345* (2013.01); *F41G 1/02* (2013.01); *F41G 1/30* (2013.01); *F41G 1/38* (2013.01)

(58) Field of Classification Search
CPC ..... F41A 9/62
USPC ..... 42/1.01, 1.02
See application file for complete search history.

(56) References Cited

U.S. PATENT DOCUMENTS

| | | | | |
|---|---|---|---|---|
| 5,142,805 | A * | 9/1992 | Horne | F41A 19/01 42/1.02 |
| 5,303,495 | A * | 4/1994 | Harthcock | F41A 9/62 42/1.02 |
| 5,592,769 | A * | 1/1997 | Villani | F41A 9/62 42/1.02 |
| 5,735,070 | A * | 4/1998 | Vasquez | F41G 1/345 42/1.02 |
| 6,094,850 | A | 8/2000 | Villani | |
| 7,926,219 | B2 * | 4/2011 | Reimer | F41G 1/38 42/1.02 |
| 2015/0226505 | A1 * | 8/2015 | Amit | F41A 19/01 42/1.02 |
| 2016/0069629 | A1 * | 3/2016 | Seckman | F41A 9/62 42/1.02 |

* cited by examiner

*Primary Examiner* — Reginald Tillman, Jr.
(74) *Attorney, Agent, or Firm* — Fraser Clemens Martin & Miller LLC; James D. Miller

(57) ABSTRACT

Systems and methods are provided that alert a firearm operator when the firearm is low on ammunition. As the operator expends ammunition, the system tracks the ammunition level and provides a visual indication within the operator's field of view when an aiming device of the firearm is being employed. In this manner, the operator's attention need not be diverted from the aiming device, yet the operator is simultaneously notified as to the ammunition status.

20 Claims, 6 Drawing Sheets

FIG. 1
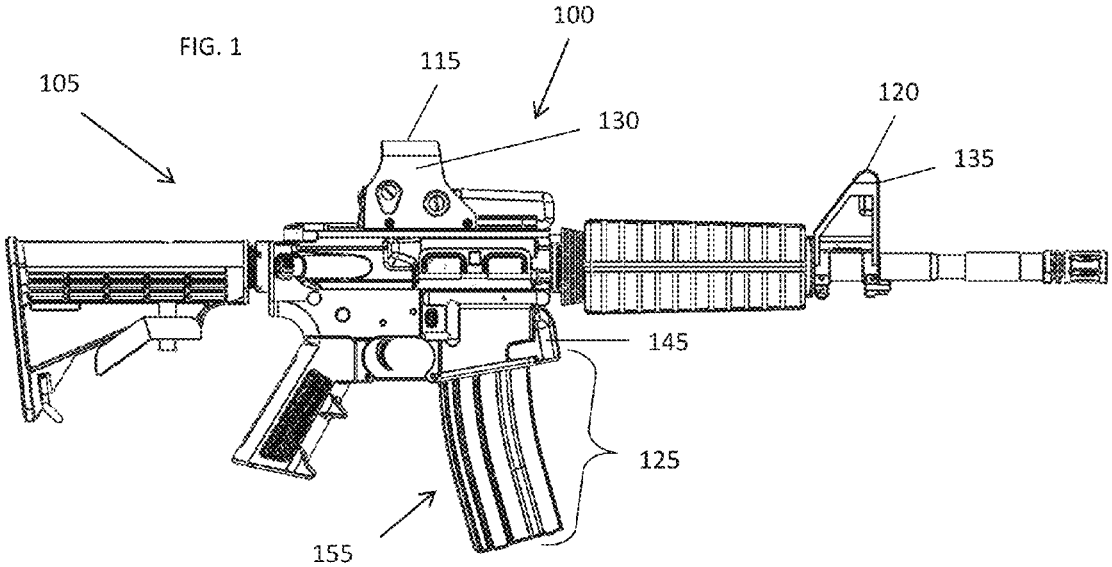
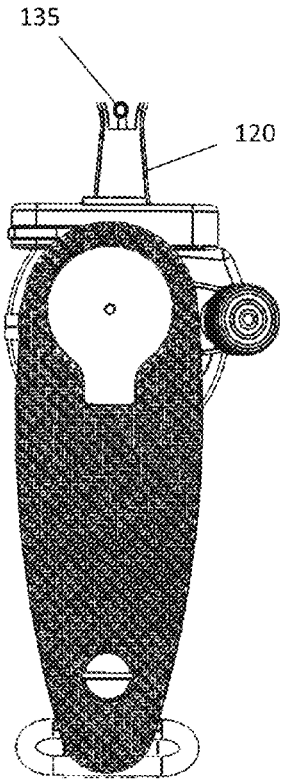
FIG. 2A
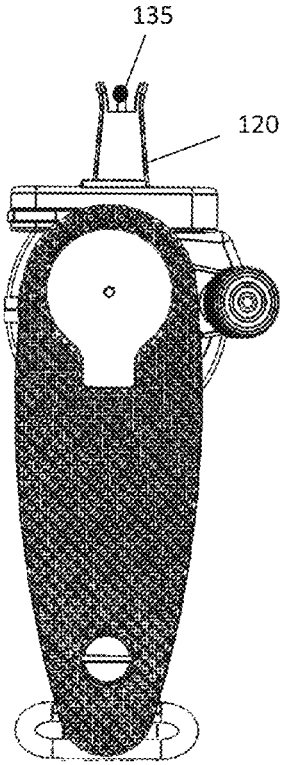
FIG. 2B

FIG. 3A
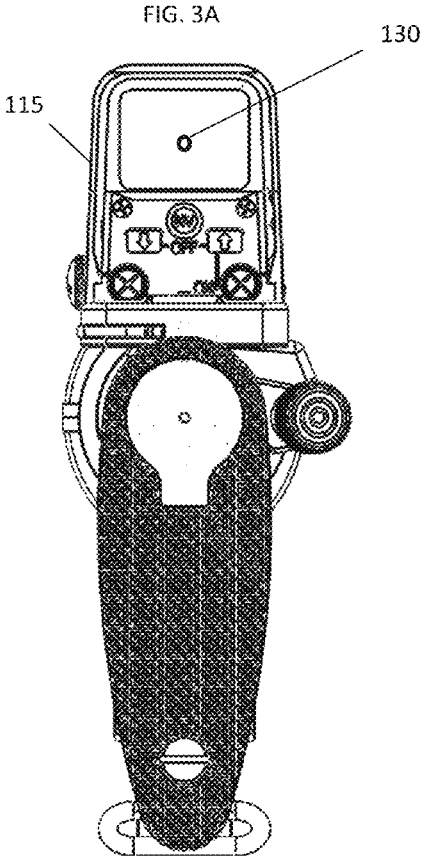
FIG. 3B
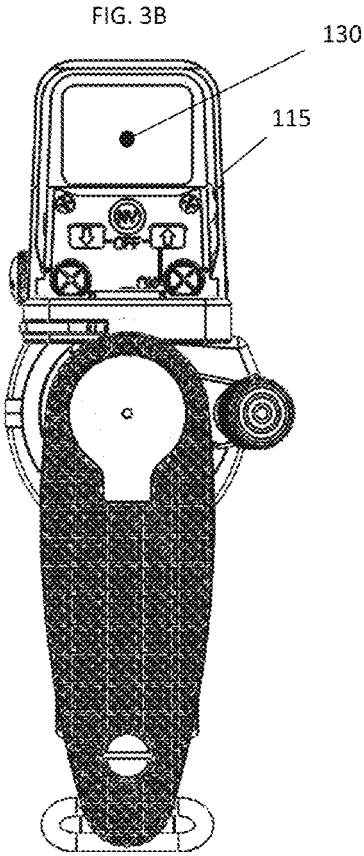
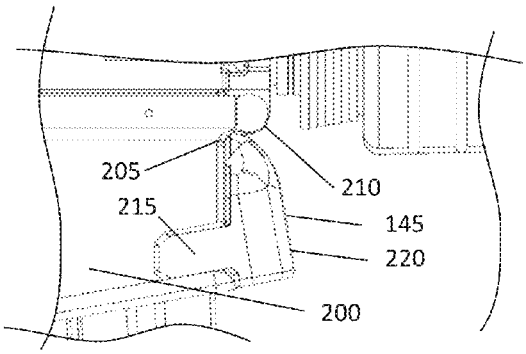
FIG. 4A
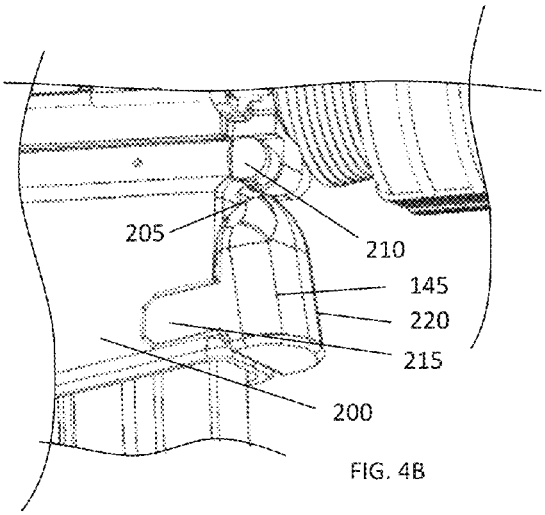
FIG. 4B

FIG. 5A
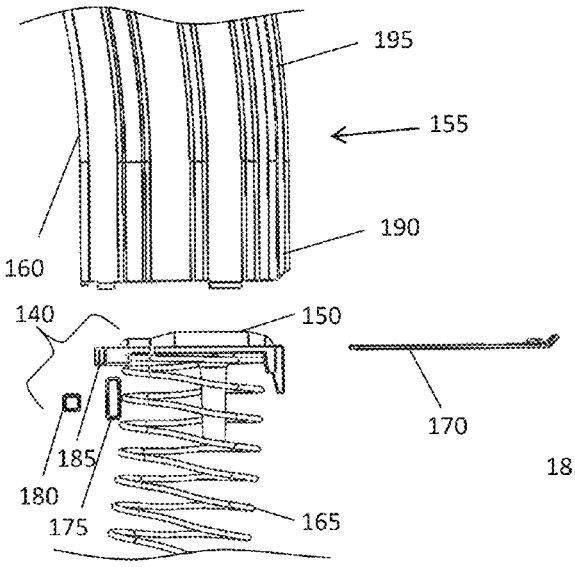
FIG. 5B
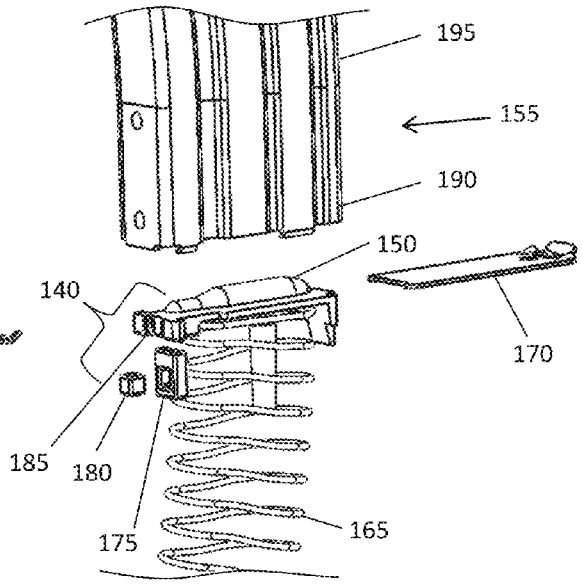
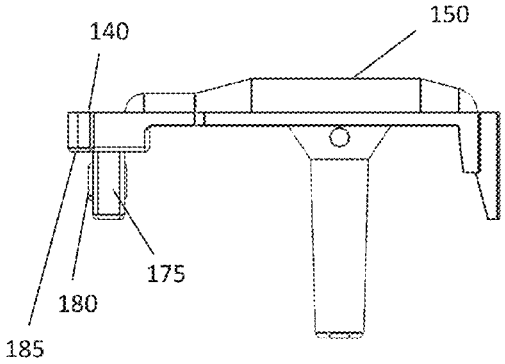
FIG. 6A
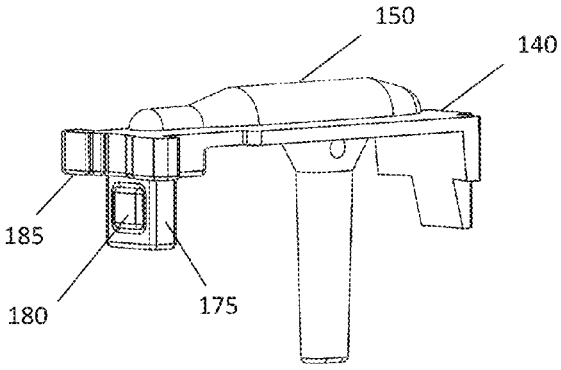
FIG. 6B

FIG. 7
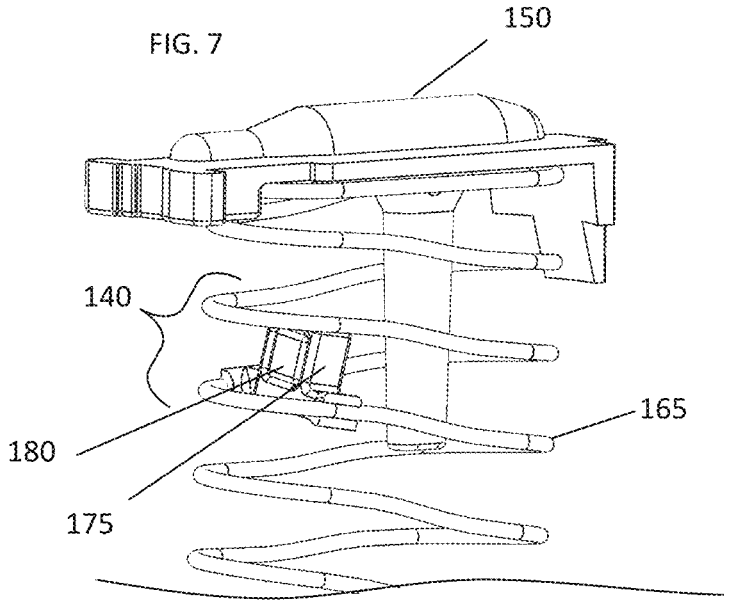
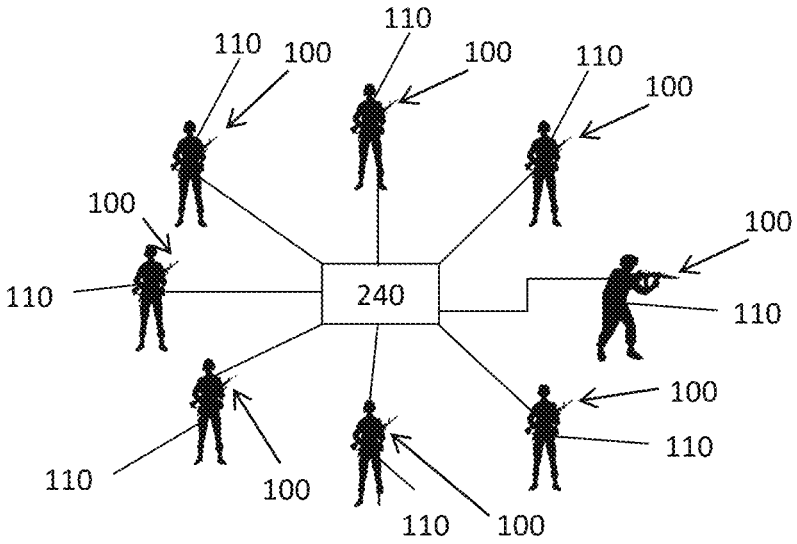
FIG. 8

AMMUNITION STATUS REPORTING SYSTEM

CROSS-REFERENCE TO RELATED APPLICATIONS

This application claims the benefit of U.S. Provisional Application No. 62/100,145, filed on Jan. 6, 2015. The entire disclosure of the above application is incorporated herein by reference.

FIELD

The present technology relates to a system for a firearm configured to provide a status of an ammunition level, such as the ammunition level remaining in a magazine for a semi-automatic or automatic firearm, where an operator can maintain focus on an aiming device while receiving the status of the ammunition level.

INTRODUCTION

This section provides background information related to the present disclosure which is not necessarily prior art.

When firing a semi-automatic or automatic firearm in various applications, including law enforcement, military, and competitive shooting applications, it can be desirable to know when an ammunition reservoir, such as a firearm magazine, is about to run out of ammunition. Competitive shooters can use this information so they can be prepared to release an empty or partially empty magazine and replace it with a full one with a minimum loss of shooting time in a course of fire. In police and military applications, the need to know ammunition status can be far more serious. Police officers and soldiers can jeopardize their lives in the split second it takes to realize a magazine must be replaced, or an enemy combatant or suspect can escape in that time. For example, under the stress of deploying a firearm or during a firefight, it can be nearly impossible for a firearm operator to keep accurate track of the amount of spent ammunition and the amount of remaining ammunition.

Ammunition level in a firearm can be checked in various ways. The firearm operator can remove a magazine to determine if ammunition remains therein. Also, various magazines can be manufactured with various windows or apertures that allow the number of cartridges and/or cartridge position therein to be viewed. For example, numbered or indexed windows or apertures can show the number of cartridges contained within the magazine or provide a quick view as to the approximate portion of the magazine that still holds ammunition or that is empty. Other types of ammunition counters can be employed, including those that provide a numeric counter or display relating to the ammunition level of the firearm. However, a considerable drawback of these ways of checking the ammunition level is that the operator must remove and/or physically inspect the magazine or the operator must divert his or her vision or attention to the counter or display. Diverting one's attention or the act of removing a magazine to check ammunition level can break the firearm operator's focus from the task at hand and can disrupt the operator from concentrating on one or more targets. This can seriously impact the effectiveness of the operator in certain scenarios, including law enforcement, military, and competitive shooting applications.

It would be desirable to provide a system capable of indicating the ammunition status of a firearm where the firearm operator would not have to divert attention away from an aiming device of the firearm.

SUMMARY

The present technology includes systems, processes, and articles of manufacture that relate to reporting an ammunition status of a firearm to an operator, the firearm including an aiming device, where the system comprises a status means and a reporting means. The status means determines the ammunition status of the firearm and the reporting means reports the ammunition status of the firearm. The reporting means receives the ammunition status of the firearm from the status means and reports the ammunition status of the firearm within a field of view of the operator when the operator is using the aiming device of the firearm. In this way, the operator is informed of the ammunition status of the firearm concurrent with use of the aiming device.

Embodiments include systems having a status element for determining the ammunition status of the firearm and a reporting element for reporting the ammunition status of the firearm. The status element can include a translation element and a signaling element. The translation element can be configured to change a position relative to the ammunition status of the firearm. The translation element can be coupled to one of a magazine follower and a magazine spring comprising part of a magazine configured to hold ammunition for the firearm. The signaling element can be configured to ascertain the position of the translation element. The signaling element can be configured to be coupled to a portion of the firearm that receives a portion of the magazine. The reporting element can receive the ammunition status of the firearm from the status element and report the ammunition status of the firearm within a field of view of the operator when the operator is using the aiming device of the firearm. The reporting element can be coupled to the aiming device or can comprise a portion of the aiming device.

Embodiments include methods that determine the ammunition status of the firearm and report the ammunition status of the firearm within a field of view of the operator when the operator is using the aiming device of the firearm.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a side elevational view depicting a system for reporting an ammunition status of a firearm to an operator, where the system is installed on a firearm including two aiming devices.

FIGS. 2A-2B are rear elevational views showing an embodiment of the system integrated with a front post sight as one aiming device, where a reporting element changes color between FIG. 2A and FIG. 2B based on a predetermined ammunition status of the firearm.

FIGS. 3A-3B are rear elevational views showing an embodiment of the system integrated with a holographic sight as another aiming device, where a reporting element changes color between FIG. 3A and FIG. 3B based on a predetermined ammunition status of the firearm.

FIGS. 4A-4F show an embodiment of a signaling element and coupling of the signaling element onto a magazine well of the firearm and cooperation of the signaling element with a retaining pin of the firearm, where fragmentary side elevational views are depicted in FIGS. 4A, 4C, and 4E, perspective views are depicted in FIGS. 4B and 4D, and a fragmentary perspective view is depicted in FIG. 4F.

FIGS. 5A-5B show exploded views of a magazine assembly including an embodiment of a translation element that couples to a magazine follower, where FIG. 5A depicts a side elevational view and FIG. 5B depicts a perspective view.

FIGS. 6A-6B show side elevational and perspective views, respectively, of the embodiment of the translation element coupled with the magazine follower.

FIG. 7 shows a perspective view of another embodiment of the translation element coupled to a magazine spring, where the translation element is separate from the magazine follower.

FIG. 8 is a schematic diagram depicting multiple systems for reporting an ammunition status of a firearm to an operator in communication with a remote entity.

DETAILED DESCRIPTION

Figure 4C:
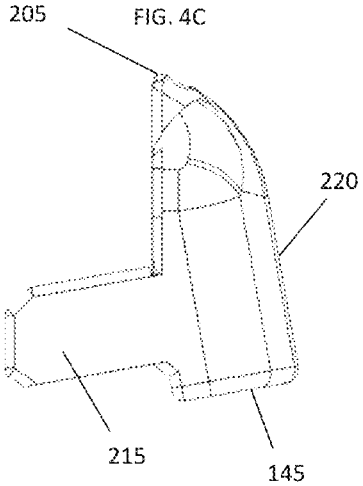
Figure 4D:
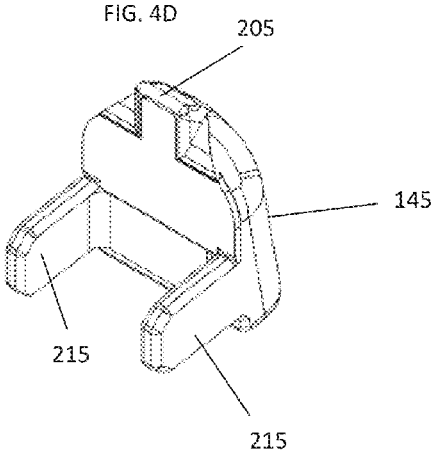
Figure 4E:
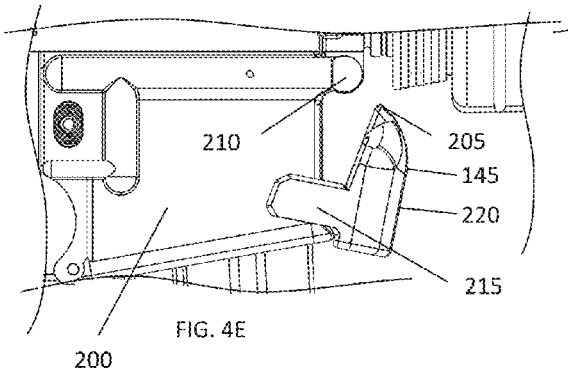
Figure 4F:
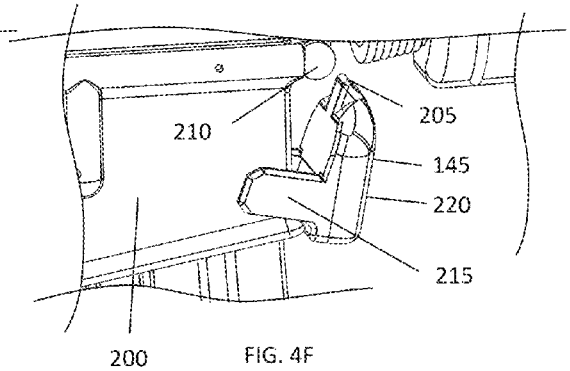

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding the methods disclosed, the order of the steps presented is exemplary in nature, and thus, the order of the steps can be different in various embodiments. Except where otherwise expressly indicated, all numerical quantities in this description are to be understood as modified by the word "about" and all geometric descriptors are to be understood as modified by the word "substantially" in describing the broadest scope of the technology.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting a system, components, or process steps, the present technology also specifically includes embodiments consisting of, or consisting essentially of, such systems, components, or process steps excluding additional systems, components, or processes (for consisting of) and excluding additional systems, components, or processes affecting the significant properties of the embodiment (for consisting essentially of), even though such additional systems, components, or processes are not explicitly recited in this application. For example, recitation of a system, component, or process reciting elements A, B and C specifically envisions embodiments consisting of, and consisting essentially of, A, B and C, excluding an element D that may be recited in the art, even though element D is not explicitly described as being excluded herein.

The present technology relates to systems, methods, and articles of manufacture that provide for reporting an ammunition status of a firearm to an operator of the firearm, where the firearm includes at least one aiming device. A status means is included for determining the ammunition status of the firearm and a reporting means is included for reporting the ammunition status of the firearm. The reporting means receives the ammunition status of the firearm from the status means and reports the ammunition status of the firearm within a field of view of the operator when the operator is using the aiming device of the firearm. In this way, the firearm operator does not have to divert his or her attention away from the aiming device. The operator can therefore continue to maintain focus on a target and/or continue to aim and discharge the firearm at one or more targets while being informed as to the ammunition status of the firearm. There is accordingly no need for the operator to break concentration on observable targets in conjunction with the aiming device in order to check ammunition status.

A system according to the present technology can include a status means and a reporting means. The status means can determine the ammunition status of the firearm. The reporting means can report the ammunition status of the firearm by receiving the ammunition status of the firearm from the status means. The reporting means can report the ammunition status of the firearm within a field of view of the operator when the operator is using the aiming device of the firearm.

The status means can include a translation means and a signaling means. The translation means can be configured to change a position relative to the ammunition status of the firearm. The signaling means can be configured to ascertain the position of the translation means and communicate the ammunition status of the firearm to the reporting means. The translation means can be coupled to a magazine follower, the magazine follower comprising part of a magazine configured to hold ammunition for the firearm. The translation means can be coupled to a magazine spring, the magazine spring comprising part of a magazine configured to hold ammunition for the firearm. The signaling means can be configured to be coupled to a portion of the firearm that receives a portion of a magazine configured to hold ammunition for the firearm. The signaling means can be configured to engage a portion of the firearm involved in assembly of the firearm. For example, the signaling means can be configured to engage a portion of a retaining pin of the firearm, requiring manipulation of the retaining pin to in order to couple or uncouple the signaling means to the firearm. The retaining pin can couple an upper assembly of the firearm with a lower assembly of the firearm. In this way, removal or manipulation of the retaining pin can be required to couple or uncouple the signaling means to the firearm. This can prevent unintentional decoupling of the signaling means from the firearm.

The translation means can include one or more magnets and the signaling means can be configured to detect the proximity of the one or more magnets. The signaling means can include one of a reed switch and a Hall effect sensor to detect the proximity of the one or more magnets. For example, as the translation means changes a position relative the ammunition status in a magazine, the signaling means can sense the position of the one or more magnets and provide a signal correlated to the ammunition status of the firearm. The translation means and the signaling means can also employ other detection methods to detect proximity and/or distance to each other. For example, one of the translation means and the signaling means can use radio-frequency identification (RFID), such as an RFID chip and the other of the translation means and the signaling means can include an RFID detector or reader. The translation means can use a passive RFID transponder that is independent of an energy source such as a battery or the like. Another example includes where the translation means is an RFID chip coupled to or embedded within a magazine follower and the signaling means is coupled to or embedded within a portion of the firearm that receives a portion of a magazine configured to hold ammunition for the firearm, such as magazine well.

The status means can provide the ammunition status of the firearm to the reporting means in various ways. The status means can be directly connected to the reporting means, where the reporting means can receive the ammunition status of the firearm by an electric signal through a wire or other physical connection, for example. The status means can also be configured to wirelessly transmit the ammunition status of the firearm and the reporting means can be configured to wirelessly receive the ammunition status of the firearm from the status means. For example, the status means and the reporting means can communicate using a wireless technology standard such as Bluetooth™. In this way, there does not have to be a physical connection between the status means and the reporting means. This can allow the apparatus to be configured for various firearm architectures and allow variable distances between the status means and the reporting means. The firearm can also be configured to facilitate communication of the ammunition status of the firearm between the status means and the reporting means. For example, coupling or mounting of the status means on the firearm can include coupling to an interface integral with the firearm that communicates with another interface integral with the firearm for coupling or mounting the reporting means.

The reporting means can be configured in various ways. The reporting means can be coupled to the aiming device of the firearm. In this manner, the reporting means can be used in conjunction with an existing aiming device or can be used to retrofit an existing aiming device. The reporting means can also comprise a portion of the aiming device or can comprise the entirety of the aiming device. Where the reporting means forms at least a portion of the aiming device, the reporting means can be integrated with the aiming device. An integrated reporting means and aiming device can form the only aiming device on the firearm or the firearm can include one or more additional aiming devices. The reporting means can be configured to work with or form part of various firearm aiming devices, including front and rear sights, including backup iron sights, a telescopic sight, a holographic sight, a reflex sight, a red dot sight, an infrared sight, a night vision sight, and a thermal sight. The aiming device can be releasably coupled to the firearm or the aiming device can be integral to the firearm, where it is formed as part of the firearm, for example. The aiming device can include one or more aiming points of reference, such as one or more dots, reticles, hashmarks, ticks, or crosshairs. Such aiming points of reference can be scaled in various ways, including mils or mil dots or minutes-of-angle. For example, the reporting means can be coupled to or be part of a telescopic sight on a firearm, where the firearm further includes backup iron sights. The reporting means can also be configured to report the ammunition status of the firearm within a field of view of the operator when the operator is using more than one aiming device of the firearm. For example, the reporting means can be part of a red dot sight that co-witnesses with front and rear sights. Alternatively, the reporting means can provide independent reporting of the ammunition status of the firearm within a field of view of the operator when the operator is using different aiming devices of the firearm. Another example includes where the reporting device provides a color change of an aiming point of reference of the aiming device when a certain ammunition status of the firearm occurs, such as when a predetermined number of trigger pulls remain in a semi-automatic firearm or when a predetermined number of defined bursts remain in a selective fire firearm.

The ammunition status of the firearm can be reported by the reporting means in various ways. These can include one or more various visual signals provided within a field of view of the operator when the operator is using the aiming device of the firearm. The ammunition status can include a representation of when a predetermined amount of ammunition remains (e.g., five rounds remain), a representation of how much ammunition remains (e.g., a numerical round count of actual rounds remaining), or step-wise representation of the amount of ammunition remaining (e.g., a visual signal indicating a full magazine, another visual signal for a half magazine, and yet another visual signal for a nearly empty magazine). The ammunition status of the firearm can be reported in various ways, including a numerical value, a color change, an intensity change, a pulsing, a flashing, a shape change, and combinations thereof. For example, all or a portion of a reticle of a holographic sight can change color, change intensity, pulse, flash, and/or change shape when one or more certain conditions relating to ammunition status of the firearm are met. As another example, the reporting means can be configured as a reticle, dot, or post of the aiming device and can change color from green to yellow to red as ammunition depletion thresholds are achieved. As yet another example, the reporting means can be configured to pulse or flash a portion of the reticle of the aiming device when the ammunition status of the firearm drops to a predetermined value.

The status means and/or the reporting means can be configured to wirelessly transmit the ammunition status of the firearm to a remote entity. In this way, the system can communicate the ammunition status of the firearm to various personnel as well as various automated reporting systems. Examples of various remote entities include other operators, a command unit, headquarters, a supply system, a maintenance system, and a scoring system. The remote entity can therefore be apprised of the ammunition status of the firearm and hence the ammunition expended by the operator. Other firearm operators and/or a commander can thereby determine whether a given operator has expended or is expending ammunition and whether the operator requires support or resupply of ammunition. A supply system remote entity can be automated to order and/or dispatch ammunition to an operator based on the ammunition status of the firearm. Where the firearm is supplied ammunition via a belt-feed, for example, the supply system can dispatch one or more large containers of ammunition associated with such firearms. Likewise, a maintenance system can track the ammunition status of the firearm to determine how many rounds have been discharged for a given firearm and schedule certain maintenance services for the firearm, such as replacement of one or more parts, cleaning, lubrication, etc. Such automated preventative maintenance can improve the performance of the firearm. For competitive shooters, a remote system can track ammunition status of the firearm where expended ammunition can be included as part of a scoring system for a competitive course of fire.

The status means and/or the reporting means can also be configured to wirelessly transmit a location and/or a direction of the system to the remote entity. The status means and/or the reporting means can include a global position system (GPS) and/or an electronic compass to determine location of the system and the direction the reporting means and hence aiming device is facing. In this way, location and direction of ammunition expenditure can be determined by the remote entity.

Methods are provided for reporting an ammunition status of a firearm to an operator, where the firearm includes an aiming device. Methods can include determining the ammunition status of the firearm and reporting the ammunition status of the firearm within a field of view of the operator when the operator is using the aiming device of the firearm. The methods can employ the various systems, elements, and features described herein. The methods can further include transmitting the ammunition status of the firearm to a remote entity. The methods can also include transmitting a location and/or a direction of the system to the remote entity.

EXAMPLES

With reference now to the figures, example embodiments of the present technology are shown.

A system 100 is shown for reporting an ammunition status of a firearm 105 to an operator 110, where the firearm includes a holographic sight 115 as a first aiming device and a front iron sight 120 as a second aiming device. The system 100 includes a status means configured as a status element 125 that determines the ammunition status of the firearm 105. The system 100 also includes a reporting means configured as a first reporting element 130 and a second reporting element 135, each configured for reporting the ammunition status of the firearm 105. As shown, the first reporting element 130 is integrated as part of the holographic sight 115 as the first aiming device and the second reporting element 135 is integrated as part of the front iron sight 120 as the second aiming device. It is understood that the system 100 may include only the holographic sight 115 and integrated first reporting element 130 or include only the front iron sight 120 and integrated second reporting element 135, depending on the type and desired configuration of aiming device(s) on the firearm 105. The first reporting element 130 and the second reporting element 135 each receive the ammunition status of the firearm 105 from the status element 125, where the first reporting element 130 and the second reporting element 135 each report the ammunition status of the firearm within a field of view of the operator 110 when the operator 110 is using the holographic sight 115 as the first aiming device and/or the front iron sight 120 as the second aiming device.

The status element 125 includes a translation element 140 configured to change a position relative to the ammunition status of the firearm 105 and a signaling element 145 configured to ascertain the position of the translation element 140 and communicate the ammunition status of the firearm 105 to the first reporting element 130 and the second reporting element 135. As shown in FIGS. 5A-5B and FIGS. 6A-6B, the translation element 140 is coupled to a magazine follower 150, where the magazine follower 150 is part of a magazine assembly 155 configured to hold ammunition for the firearm 105. As shown in the exploded view of FIGS. 5A-5B, the magazine assembly 155 is configured as a detachable box magazine having a magazine box 160 into which the magazine follower 150, including the translation element 140, and a magazine spring 165 are inserted and contained by a base plate 170. It is understood that other types of magazine assemblies 155 can be employed, including integral box magazines, tubular magazines, rotary magazines, horizontal magazines, casket magazines, rotary magazines, pan magazines, and drum magazines. Another embodiment the translation element 140 is shown in FIG. 7, where the translation element 140 is coupled to the magazine spring 165 near the magazine follower 150, the magazine spring 165 comprising part of the detachable box magazine configured to hold ammunition for the firearm 105. In this way, the translation element 140 is separate from the magazine follower 150.

The translation element 140 includes a body 175 that receives a magnet 180. In the embodiment shown in FIGS. 5A-5B and FIGS. 6A-6B, the body 175 can be coupled to the magazine follower 150 by snapping into an underside 185 of the magazine follower 150 so as not to interfere with loading of the magazine assembly 155. It should be understood that the body 175 of the translation element 140 can also be formed as an integral portion of the magazine follower 150. Likewise, the magazine follower 150 and body 175 of the translation element 140 can be formed around the magnet 180 using various methods; e.g., injection molding. Integrating the body 175 and magnet 180 with the magazine follower 150 can simplify construction and make the integrated product resistant to disassembly. As shown in the embodiment depicted in FIG. 7, the body 175 of the translation element 140 can also be coupled to the magazine spring 165 near the magazine follower 150 so that the translation element 140 is separate from the magazine follower 150.

The magnet 180 received in the body 175 of the translation element 140 changes position relative to the ammunition status of the firearm 105. With respect to the embodiment of the magazine assembly 155 shown as a detachable box magazine, the magazine spring 165 is compressed inside the magazine box 160 relative to the amount of ammunition pressing against the magazine follower 150. As ammunition is loaded into the magazine assembly 155 or expended or removed from the magazine assembly 155, the magazine spring 165 compresses or expands respectively against the magazine follower 150, along with the translation element 140. For example, as ammunition is expended, the magnet 180 moves from a lower portion 190 of the magazine assembly 155 to an upper portion 195 of the magazine assembly 155.

As noted, the signaling element 145 is configured to ascertain the position of the translation element 140 and communicate the ammunition status of the firearm 105 to at least one of the first reporting element 130 and the second reporting element 135. The signaling element 145 is shown in FIGS. 1, 4A-4B, and 4E-4F, as coupled directly to a magazine well 200 of the firearm 105. The magazine well 200 is a portion of the firearm 105 that receives a portion of the magazine assembly 155, such as the detachable box magazine depicted. However, it is understood that the signaling element 145 may be coupled to the magazine assembly 155 or to other portions of the firearm 105. The embodiment of the signaling element 145 shown includes a retaining tab 205 that is configured to engage a portion of a retaining pin 210 of the firearm 105, requiring manipulation of the retaining pin 210 in order to couple or uncouple the signaling element 145 to the firearm 105. In this way, the retaining tab 205 is held behind the retaining pin 210 and the signaling element 145 is effectively fixed to the firearm 105 and cannot be removed without sliding the retaining pin 210 out past the retaining tab 205. The signaling element 145 is therefore secured to the firearm 105 through impact or shock. It is understood that the signaling element 145 can be configured to require partial or complete removal of the retaining pin 210 for installation or removal from the firearm 105 and/or partial or complete disassembly of the firearm 105 may be necessary for installation or removal of the signaling element from the firearm 105. The embodiment of the signaling element 145 shown further includes resilient tabs 215 that snap onto either side of the magazine well 200 of the firearm 105 to further secure the signaling element 145 to the firearm 105 and provide a flush fit with the magazine well 200. A gripping surface 220 can be provided on an outer surface of the signaling element 145, where the gripping surface can include a texture and/or material (e.g., rubber) that enhances gripping by the operator 110. It is understood that the gripping surface 220 can be larger than shown in the figures and can include one or more finger grooves (not shown) to further aid the operator 110 in securely gripping the firearm 105.

The embodiment of the signaling element 145 shown is configured to detect the proximity of the magnet 180 of the translation element 140. In particular, the signaling element 145 includes one of a reed switch and a Hall effect sensor that can sense the proximity of the magnet 180 and can provide a change in a signal in relation to proximity of the magnet 180 and hence the strength of the related magnetic field. The proximity of the magnet 180 is converted by the signaling element 145 to a signal indicative of the ammunition status of the firearm 105, where the signal is communicated to the respective reporting element 130, 135.

In the embodiments shown, the first reporting element 130 and the second reporting element 135 are each configured to receive the signal indicative of the ammunition status of the firearm 105 from the status element 125, which includes the translation element 140 and the signaling element 145. The signaling element 145 is configured to wirelessly transmit the ammunition status of the firearm 105 and the respective reporting elements 130, 135 are configured to wirelessly receive the ammunition status of the firearm 105 from the signaling element 145. It should be understood that the signaling element 145 can also be hard wired to the respective reporting elements 130, 135. In this way, the translation element 140 including the magnet 180 presents a position relative to the ammunition status of the firearm, where the reed switch or Hall effect sensor of the signaling element 145 ascertains the position of the translation element 140 and associated magnet or a change in position of the translation element 140 and associated magnet 180. The signaling element 145 then wirelessly communicates a signal indicative of the ammunition status of the firearm 105 to the respective reporting element 130, 135.

With reference to FIGS. 2A-2B and 3A-3B, the first reporting element 130 and the second reporting element 135 form a portion of the holographic sight 115 and the front iron sight 120, respectively. With respect to the holographic sight 115, the first reporting element 130 changes color to indicate a predetermined ammunition status of the firearm 105; compare the color of the first reporting element 130 in FIG. 3A versus FIG. 3B. Likewise, the second reporting element 135 of the front iron sight 120 changes color to indicate a predetermined ammunition status of the firearm 105; compare the color of the second reporting element 135 in FIG. 2A versus FIG. 2B. The predetermined ammunition status of the firearm 105 can be where the magazine assembly 155 has only five rounds of ammunition remaining, for example.

Figure 9A:
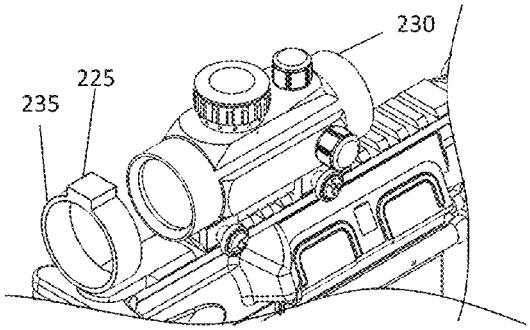
FIGS. 9A-9B show perspective views of the coupling of yet another embodiment of a reporting element to yet another aiming device of a firearm.
Figure 9B:
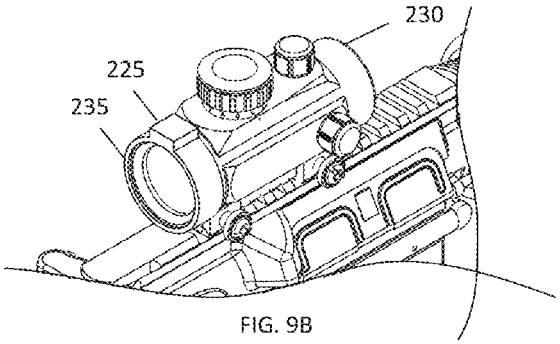

An alternate embodiment of a reporting element 225 that can be coupled to an aiming device 230 of a firearm 105 is shown in FIGS. 9A-9B. Here, the reporting element 225 is not integrated into the aiming device 230. As depicted, the reporting element 225 is configured as ring that slides onto an optical sight used as the aiming device 230. An existing aiming device 230 can be outfitted or retrofitted with the reporting element 225 of the present system 100 in this manner. All or a portion of the ring edge 235 facing the operator 110 can accordingly report the ammunition status of the firearm 105 within a field of view of the operator 110 when the operator 110 is using the aiming device of the firearm 105. For example, the ring edge 235 can change color, in a similar fashion to the first reporting element 130 in FIG. 3A versus FIG. 3B and the second reporting element 135 in FIG. 2A versus FIG. 2B. Alternatively, the reporting element 225 coupled to the aiming device 230 can communicate with the aiming device 230 to cause an indication of the ammunition status of the firearm 105 using a feature of the aiming device 230, such as color change, pulsing, or flashing in the reticle or red dot of the aiming device 230.

The system 100 for reporting an ammunition status of a firearm 105 to an operator 110 can also wirelessly communicate the ammunition status of the firearm 105 to a remote entity 240, as shown in FIG. 8. Likewise, multiple systems 100 can each be configured to transmit the ammunition status of the respective firearm 105 to the remote entity 240. The remote entity 240 can be another operator 110, a command unit or headquarters, a supply system, a maintenance system, or combinations of these entities. For example, where the status element 125 includes the signaling element 145, the signaling element can wirelessly communicate the ammunition status of the firearm 105 to the first reporting element 130 and/or the second reporting element 135 as well as the remote entity 240. Alternatively, the first reporting element 130 and/or the second reporting element 135 can relay the ammunition status of the firearm 105 received by the signaling element to the remote entity 240. The remote entity 240 can therefore ascertain the ammunition status of the firearm 105 for one or more operators 110. The system 100 can further include a global position system (GPS) and an electronic compass to wirelessly transmit a location of the system 100 and a direction that the system 100 is facing to the remote entity 240. Thus, the remote entity 240 can determine where the operator 110 is located, the direction the system 100, and likely the operator 110, is facing, as well as the ammunition status of the firearm 105 associated with the system 100.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A system for reporting an ammunition status of a firearm to an operator, the firearm including an aiming device, the system comprising:

a status means for determining the ammunition status of the firearm; and a reporting means for reporting the ammunition status of the firearm, the reporting means receiving the ammunition status of the firearm from the status means, the reporting means reporting the ammunition status of the firearm within a field of view of the operator when the operator is using the aiming device of the firearm, wherein the reporting means comprises a portion of the aiming device and includes at least one aiming point of reference, the at least one aiming point of reference including a visual signal based on the ammunition status.

2. The system of claim 1, wherein the status means comprises:

a translation means configured to change a position relative to the ammunition status of the firearm; and a signaling means configured to ascertain the position of the translation means and communicate the ammunition status of the firearm to the reporting means.

3. The system of claim 2, wherein the translation means is coupled to a magazine follower, the magazine follower comprising part of a magazine configured to hold ammunition for the firearm.

4. The system of claim 2, wherein the translation means is coupled to a magazine spring, the magazine spring comprising part of a magazine configured to hold ammunition for the firearm.

5. The system of claim 2, wherein the translation means includes a magnet.

6. The system of claim 2, wherein the signaling means is configured to be coupled to a portion of the firearm that receives a portion of a magazine configured to hold ammunition for the firearm.

7. The system of claim 2, wherein the signaling means is configured to engage a portion of a retaining pin of the firearm, and wherein manipulation of the retaining pin is required to couple the signaling means to or uncouple the signaling means from the firearm.

8. The system of claim 5, wherein the signaling means is configured to detect a proximity of the magnet.

9. The system of claim 8, wherein the signaling means includes one of a reed switch and a Hall effect sensor.

10. The system of claim 1, wherein the status means is configured to wirelessly transmit the ammunition status of the firearm and the reporting means is configured to wirelessly receive the ammunition status of the firearm from the status means.

11. The system of claim 1, wherein the reporting means is coupled to the aiming device.

12. The system of claim 1, wherein the aiming device includes a member selected from the group consisting of front and rear sights, a telescopic sight, a holographic sight, a reflex sight, a red dot sight, an infrared sight, a night vision sight, and a thermal sight.

13. The system of claim 1, wherein the ammunition status of the firearm is reported as a member selected from the group consisting of a numerical value, a color change, an intensity change, a pulsing, a flashing, a shape change, and combinations thereof.

14. The system of claim 1, wherein the reporting means provides the ammunition status of the firearm when the ammunition status of the firearm is at a predetermined value.

15. The system of claim 1, wherein one of the status means and the reporting means is configured to wirelessly transmit the ammunition status of the firearm to a remote entity.

16. The system of claim 15, wherein the remote entity is a member selected from the group consisting of another operator, a command unit, a supply system, a maintenance system, and combinations thereof.

17. The system of claim 15, wherein one of the status means and the reporting means is configured to further wirelessly transmit to the remote entity a member selected from the group consisting or a location, a direction, and combinations thereof.

18. A system for reporting an ammunition status of a firearm to an operator, the firearm including an aiming device, the system comprising:

a status element for determining the ammunition status of the firearm, wherein the status element includes:

a translation element configured to change a position relative to the ammunition status of the firearm, wherein the translation element is coupled to one of a magazine follower and a magazine spring comprising part of a magazine configured to hold ammunition for the firearm; and a signaling element configured to ascertain the position of the translation element, wherein the signaling element is configured to be coupled to a portion of the firearm that receives a portion of the magazine configured to hold ammunition for the firearm; and a reporting element for reporting the ammunition status of the firearm, the reporting element receiving the ammunition status of the firearm from the status element, the reporting element reporting the ammunition status of the firearm within a Field of view of the operator when the operator is using the aiming device of the firearm, wherein the reporting element comprises a portion of the aiming device and includes at least one aiming point of reference, the at least one aiming point of reference including a visual signal based on the ammunition status and the reporting element is coupled to the aiming device or comprises a portion of the aiming device.

19. A method of reporting an ammunition status of a firearm to an operator, the firearm including an aiming device, the method comprising: determining the ammunition status of the firearm; and reporting the ammunition status of the firearm within a field of view of the operator when the operator is using the aiming device of the firearm using a reporting means, wherein the reporting means comprises a portion of the aiming device and includes at least one aiming point of reference, the at least one aiming point of reference including a visual signal based on the ammunition status.

20. The system of claim 1, wherein the at least one aiming point of reference includes a member selected from the group consisting of a dot, a reticle, a hashmark, a tick, and a crosshair.

* * * * *